United States Patent [19]

Talbot

[11] Patent Number: 4,528,905

[45] Date of Patent: Jul. 16, 1985

[54] ROTARY NUMBERING MACHINE

[75] Inventor: George M. Talbot, Massapequa, N.Y.

[73] Assignee: Atlantic Control Systems, Inc., Brooklyn, N.Y.

[21] Appl. No.: 243,652

[22] Filed: Mar. 13, 1981

[51] Int. Cl.[3] ..... B41J 1/42

[52] U.S. Cl. ..... 101/76; 101/85; 101/99; 101/110

[58] Field of Search ..... 101/79, 80, 81, 85, 101/88, 89, 110, 70, 82, 76, 77, 95, 96, 96 RC, 97, 99, 100, 101, 106, 107, 108, 83, 84, 75, 87

[56] References Cited

U.S. PATENT DOCUMENTS

| | | | |
|---|---|---|---|
| 352,137 | 11/1886 | Lee . | |
| 741,311 | 10/1903 | Culley . | |
| 980,416 | 1/1911 | Higgin | 101/97 |
| 986,338 | 3/1911 | Wosinski | 101/83 |
| 1,337,232 | 4/1920 | Kern | 101/89 |
| 2,899,891 | 8/1959 | Nishigori et al. | 101/83 |
| 3,112,688 | 12/1963 | Pannier . | |
| 3,815,495 | 6/1974 | Strackbein | 101/79 X |
| 4,055,116 | 10/1977 | Roberts et al. . | |

FOREIGN PATENT DOCUMENTS

| | | | |
|---|---|---|---|
| 2847881 | 11/1979 | Fed. Rep. of Germany | 101/110 |
| 2801 | of 1913 | United Kingdom | 101/95 |
| 464845 | 4/1937 | United Kingdom | 101/88 |

OTHER PUBLICATIONS

British Printer, Jan. 1980, pp. 47, 49 & 50, "An ABC of Numbering", Article by Krendel.

Graphic Arts Monthly, Nov. 1979, p. 180 and Apr. 1980, p. 159.

*Primary Examiner*—Edgar S. Burr

*Assistant Examiner*—Charles A. Pearson

*Attorney, Agent, or Firm*—Hopgood, Calimafde, Kalil, Blaustein & Judlowe

[57] ABSTRACT

The invention contemplates a machine having serial-number printing capability and comprising a first plurality of print wheels which are serially indexed for each of a succession of input actuations. An indexing pawl has a second plurality of spaced wheel-indexing pawl elements, one for each of a corresponding second plurality of adjacent print wheels. The number of print wheels is greater than the number of pawl elements, and the pawl is mounted for selective longitudinal placement so as to coact with a desired particular second plurality of adjacent print wheels. The print wheels incorporate the feature of selective removal from printing exposure, so that printing need only involve digit indicia on print wheels requisite to serial-number printing at the selected longitudinal region of pawl action.

12 Claims, 8 Drawing Figures

ROTARY NUMBERING MACHINE

BACKGROUND OF THE INVENTION

The invention relates to a numbering machine of the type wherein a nested plurality of print wheels carry printing indicia at peripherally spaced locations, and wherein a reciprocated pawl is the instrumentality whereby indexing of print wheels is accomplished.

In the serial-number printing of documents, such as checks, bank notes, stock certificates or the like, it is customary to clamp a unitary numbering machine into a frame of set type, electrotype or the like, with which numbers are to be serially printed in a press, there being an index of print-wheel position in the interval between successive print impressions. Different jobs can call not only for different successions of serial numbers, but also for different location of the numbers, in reference to remaining set composition of the material to be printed. It has been past practice and necessity to remount the numbering machine within the clamped composition, whenever number relocation has been called for, and of course there is an added cost factor in any such remounting, particularly for relatively small-volume jobs.

BRIEF STATEMENT OF THE INVENTION

It is an object of the invention to provide an improved numbering machine of the character indicated, avoiding limitations of prior machines, and without sacrifice of quality or volume of printed product.

It is a specific object to provide such a numbering machine wherein the location of serial-numbering to be printed within a given format may be selectively shifted without requiring a remounting of the numbering machine in a given printing press.

The invention achieves the above objects and other features by providing for the nested support of a plurality of print wheels wherein such plurality exceeds the number of digit positions to be accommodated within the spread of serial numbers to be printed; for example in a job to be serially numbered from 1 to 9999, only four print wheels are required, but the invention provides a plurality of print wheels exceeding four, for example, nine or ten print wheels, all in the same numbering machine that is clamped or otherwise mounted in a given printing press. A pawl is provided for indexing digit wheels, there being as many pawl elements, at digit-wheel intervals, as are needed for the kind of jobs to be performed—in the assumed case, the pawl has separate pawl elements for the indexing of digit wheels in a cluster of four. The pawl is mounted with a capability of selective longitudinal repositioning, say to serve a first cluster of four print wheels for one job, and to serve a different cluster of four print wheels for a second job, all without involving any remounting of the numbering machine. All digit wheels have provision for rendering the same inoperative to print, by removing the same from printing exposure, so that only the print wheels involved in performing a given serial-number printing job will have printing exposure.

DETAILED DESCRIPTION

The invention will be described in detail for a preferred embodiment, in conjunction with the accompanying drawings, in which.

Figure 1:
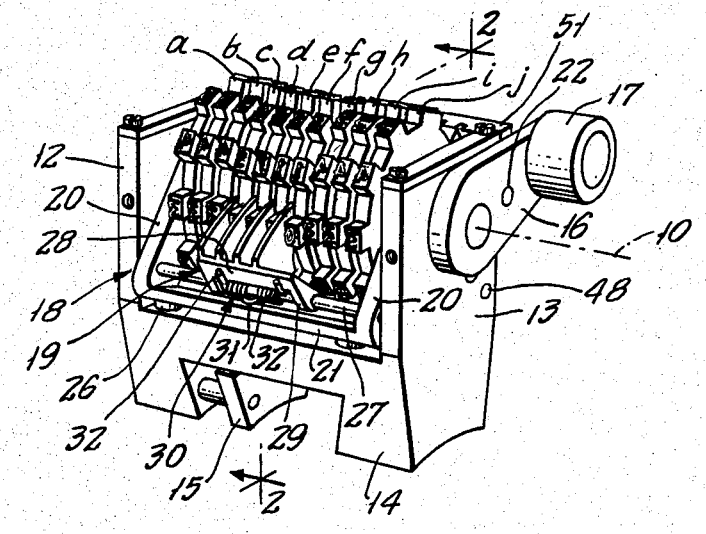
FIG. 1 is a perspective view of a numbering machine of the invention.
Figure 2:
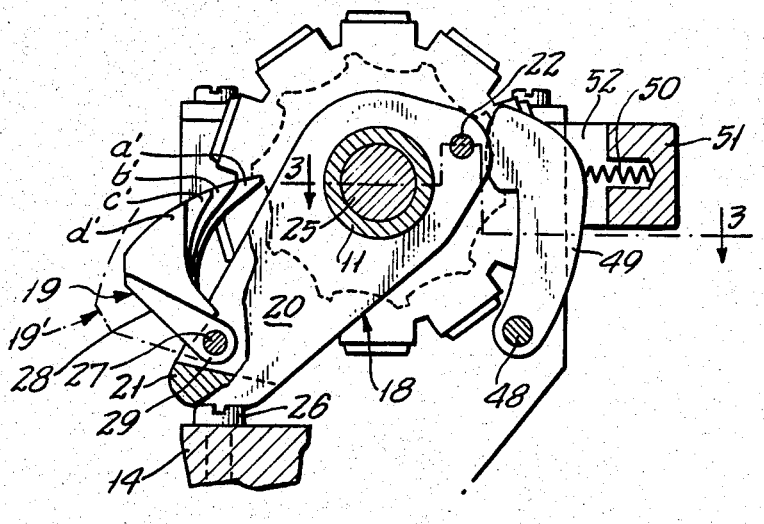
FIG. 2 is a fragmentary sectional view partly broken-away, and taken in the plane 2—2 of FIG. 1.
Figure 3:
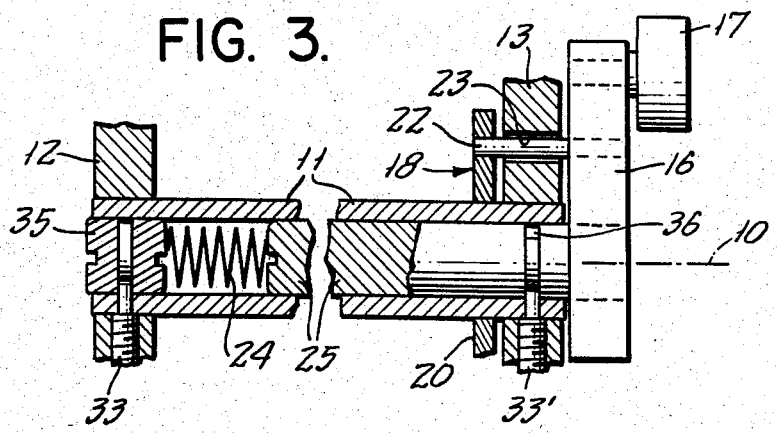
FIG. 3 is a fragmentary horizontal sectional view taken at 3—3 in FIG. 2.
Figure 4:
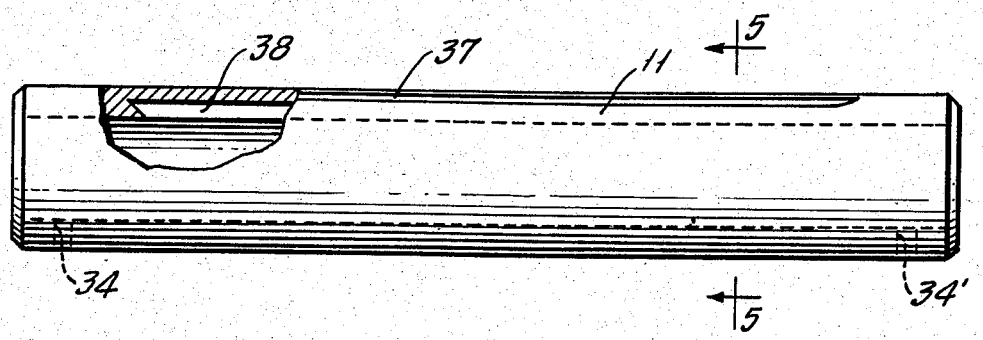
FIG. 4 is a view in elevation of shaft structure in the machine of FIG. 1.
Figure 5:
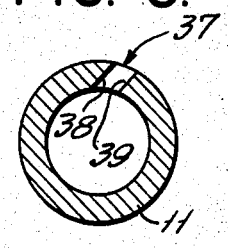
FIG. 5 is an enlarged sectional view at 5—5 of FIG. 4.

The machine of FIGS. 1 to 3 comprises a nested plurality of print wheels a, b, c. . . . j, mounted for indexible rotation about a single axis 10, which axis is established by the cylindrical outer surface of a tubular shaft 11 having fixed end support in spaced pedestals 12–13 which extend upwardly from a mounting base 14. The underside of base 14 incorporates adjustable gib or clamp means 15 for removable fixation in a printing press; means 15 may be adapted in conjunction with an otherwise flat underside of base 14 for flat-bed mounting in a press, but as shown the underside of base 14 is a concave cylindrical arc for mounting to a so-called dovetail holding ring, wherein the thus-mounted numbering machine is gyrated in continuous rotation, in the course of making a printed impression once per gyrated revolution. An actuating crank 16 with cam-follower roll 17 is cam or otherwise driven once per print cycle, to generate a limited arc of crank (16) reciprocation, from which corresponding angular reciprocation is imparted to a swing 18 and thus also to indexing pawl means 19 mounted thereon.

More specifically, the swing 18 comprises two spaced arms 20 rigidly interconnected by an outboard elongate bar 21, each arm 20 deriving journal support from shaft 11, at a location outside a different one of the ends of the print-wheel cluster and adjacent the nearby pedestal 12–13. Crank 16 has a pinned connection 22 to the adjacent swing arm, and pedestal 13 has an arcuate slot 23 about axis 10 to permit limited angular reciprocation of crank 16 and swing 18, in unison. A suitably compliant coil spring 24 within tubular shaft 11 provides torsional preload to an auxiliary shaft 25 which is journalled in the bore of tubular shaft 11 and provides rotary support of crank 16 on the axis 10. The direction of torsional preload is normally to place crank 16 in the elevated position shown in FIG. 1, with abutment means such as the head of one or more screws 26 set in base 14, to determine a stop position of engagement by the swing bar 21.

It is a feature of the invention that the pawl means 19 is a unitary structure having a plurality of pawl elements a'-b'-c'-d' at fixed longitudinal spacing and progressively angularly offset and selectively positionable along an elongate pintel or rod 27 which is fixed to the end arms 20 of the swing structure, the selected position being such as to involve serial-indexing coaction with a corresponding plurality of print wheels, and the indexed plurality (a' to d') being a lesser number than the total plurality of index wheels (a through j). More specifically, pawl means 19 is shown to comprise a flat base 28 with spaced arms or bosses 29 by which it derives longitudinally slidable pivoted support from rod 27. Between bosses 29 and centered by rod 27, a coil spring 30 is retained; as shown, spring 30 has a central arm 31 which bears upon the swing bar 21, and two spaced outer arms 32 which bear upon the pawl base 28, it being understood that spring 30 is preloaded to continuously urge its pawl elements a'-b'-c'-d' in the direction of print-wheel engagement. In FIG. 2, the phantom outline 19' will be understood to designate a counter-clockwise position of pawl retraction, out of possible print-wheel engagement, to permit sliding displacement of the pawl and its spring 30 to some other selected longitudinal position.

Shaft 11 and a typical one of its print wheels will be discussed in particular reference to FIGS. 3 to 8. Shaft 11 is held, fixed against rotation, by reduced pin ends of elongate screws 33–33' set in tapped holes in the respective frame pedestals 12–13. These reduced pin ends pass through radial holes 34–34' at the ends of shaft 11. In the case of screw 33, the pin end enters a diametrically extending bore in a plug 35, which is slotted at one end for screwdriver torquing and which is slotted at its other end for torsionally preloading engagement with the adjacent end of spring 24, it being noted that the other end of spring 24 has similar engagement with the slotted inner end of the crank shaft 25; in setting crank 16 for a given resilient preload to its position shown in FIG. 1, plug 35 is screwdriver rotated until desired torsional preload is achieved, before finally advancing screw 33 to its home position of retaining plug 35 at its adjusted-preload position. At the other end, the pin end of screw 33' passes through the shaft hole 34' and in its home position enters a circumferential groove 36 in auxiliary shaft 25, thus axially retaining crank 16 and its shaft 25. For a purpose which will become clear, shaft 11 is recessed or slotted at 37, the slot 37 being longitudinally coextensive with the overall span of the print-wheel cluster. Slot 37 is characterized by opposed parallel sidewalls 38–39 which are generally radially directed but which are also offset to one side of strict alignment with the shaft axis.

Figure 6:
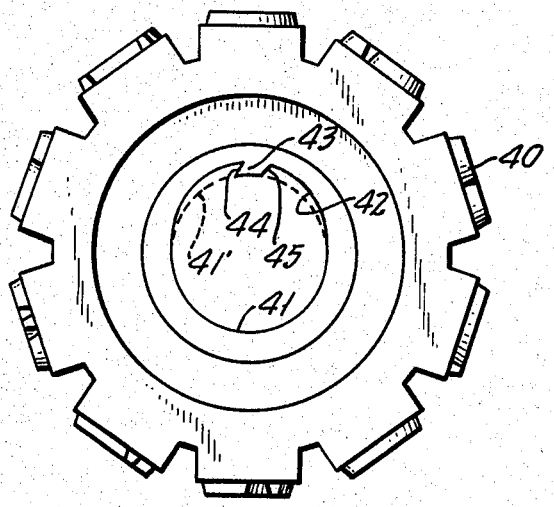
FIGS. 6 and 7 are the respective end views of a print wheel, typical of those in the machine of FIG. 1.
Figure 7:
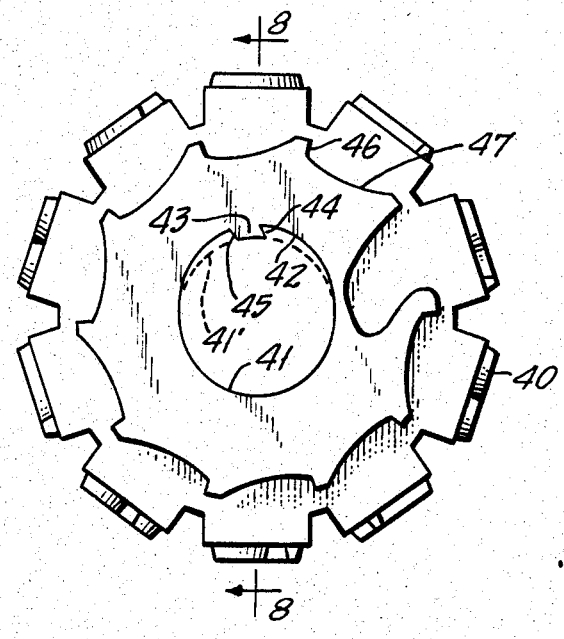
Figure 8:
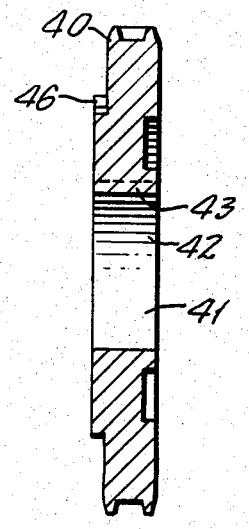
FIG. 8 is a sectional view at 8—8 of FIG. 7.

Each print wheel, such as the wheel depicted in FIGS. 6, 7 and 8 has a plurality of numerical printing indicia 40, at equal angular spacing about the wheel periphery. Coaxial with the locus of these indicia 40, the wheel mounting bore is characterized by a first semicylindrical arc 41 deriving semicylindrical bearing support from the outer surface of shaft 11; the remainder of the mounting bore is characterized (a) by a second substantially semicylindrical arc 42 which is eccentrically offset from the center of arc 41 and (b) by a generally radially inward tooth formation 43 within the eccentric arc 42. The tooth 43 has an inner limit at the geometric cylinder 41' of arc 41, and tooth 43 is further preferably characterized by opposed parallel sidewalls 44–45 spaced and sloped for selective entry into the shaft slot 37.

As seen in FIG. 7, the typical print wheel is further characterized on one of its side faces by ratchet-tooth formations 46 destined for pawl-element indexing engagement and escapement, and by cam-sloped concavities 47 between ratchet teeth, for retaining-pawl engagement. As seen in FIG. 2, a pivot rod 48 supported by and between pedestals 12–13 carries a plurality of retaining pawls 49, each of which is contoured for retaining engagement with one of the concavities 47, upon wheel-indexed displacement from one to the next of its sequence of printing indicia 40; and a separate local compression spring 50, within each one of a succession of bores in an elongate frame bar 51 bolted to the pedestals 12–13, constantly urges its associated retaining pawl 49 into print-wheel engagement. Slot walls 52 at each spring (50) location keep each retaining pawl 49 in constant tracking alignment with the ratchet system 46–47 of the print wheel it individually serves.

Preferably, the locating means 33–33' so retains orientation of the slot 37 in shaft 11 that one or more tooth formations 43 can only enter slot 37 at a wheel position which is offset from an indexed position of digit-printable exposure, thus assuring that tooth formation 43 will always provide a concentric-bearing function in cooperation with the arc 41, whatever the digit-printable indexed position of a given print wheel. Preferably also, at slight angular offset beyond the zero-indicium printing position, each print wheel is available for manipulated depression, placing a tooth 43 in slot 37 and therefore withdrawing the particular print wheel from printing exposure. Still further preferably, the orientation of slot 37 is such that the direction of retaining pawl (49) loading on the print wheel is such as to load the undercut tooth face 44 into inwardly camming engagement with the coacting surface 38. However, upon further rotation of the print wheel in the index-advance direction, whether by pawl-actuation or by manual actuation, the retracted print wheel is cammed out of its withdrawn position and into its concentric position of printing exposure, through cam coaction of the tooth and slot surfaces 45–39; once restored to the position of concentricity with shaft 11, the next indicium-index position is retained by the associated pawl 49, as will be understood.

It will be seen that the described numbering machine meets all stated objects. The selection or re-selection of a given cluster of digit positions to be serial-number printed is a simple matter of manually retracting the index pawl 19 and then sliding the same to a new position along rod 27. And since all print wheels are of the same construction, additional wheels can be depressed out of printing exposure, to accommodate the newly selected grouping of wheels to be serial-number indexed. Further, it will be appreciated that if the sequence to be printed extends from a smaller to a larger number of digit positions, e.g., from printable number 51 (2 digit positions) to printable number 150 (3 digit positions), the print wheel for the third digit position (unused in the sequence from 51 to 99) may be in its retracted position, and yet this third digit-position wheel will be automatically brought into printing exposure (to print its first indicium, the number 1) when crank 16 moves pawl 19 to index from number 99 to the number 100.

Although the invention has been described in detail for a preferred embodiment, it will be understood that modifications may be made without departing from the scope of the invention.

What is claimed is:

1. A rotary serial-number printing machine, comprising a frame including a base adapted for fixed mounting and two spaced pedestals upstanding from said base, shaft means extending between spaced supports in said pedestals and a nested plurality of adjacent indexible print wheels carried by said shaft means, an indexing swing comprising tow spaced arms having journalled support on said shaft between the respective ends of the nested plurality of print wheels and the adjacent pedestal, said swing including an elongate rigid spacer connecting said arms, an elongate rod fixedly supported by and between said arms, an indexing pawl having journalled support on said rod and having a clustered plurality of pawl-tooth elements at spaced intervals corresponding to the individual print-wheel width dimension, said pawl-tooth elements being progressive angularly offset relation, the plurality of print wheels being greater than the plurality of pawl-tooth elements of said indexing pawl, and the axial accommodation of said pawl on said rod being within the space between arms of said swing, spring means reacting between said pawl and the spacer of said swing and urging said pawl into print-wheel engagement, said pawl being pivotally manipulable against the action of said spring to an extent clearing print-wheel contact and said pawl being selectively positionable along said rod for serial-numbering coaction with a particular selected cluster of some but not all of said print wheels, and means including a crank for imparting intermittent print-wheel-indexing angular oscillation to said swing.

2. The printing machine of claim 1, in which each print wheel carries a succession of different printing indicia at angularly spaced indexible increments on the periphery thereof, each wheel being of a variety in which for one angular position thereof no printing indicium has printing exposure.

3. The printing machine of claim 1, in which a second elongate rod is fixedly supported by and between said pedestals in clearance with said print wheels and with the path of movement of said swing, and a plurality of retainer pawls supported by and along said second rod, said plurality of retainer pawls corresponding to the plurality of print wheels, with each retainer pawl having spring-loaded independent index-retaining engagement with a different one of said print wheels.

4. The printing machine of claim 2, in which in the region of print-wheel support said shaft means has a cylindrical outer surface except for an elongate radial recess at one fixed angular location, each print wheel having a bore characterized (a) by a first semicylindrical arc concentric with the peripheral locus of printing indicia thereon, (b) by a second cylindrical arc eccentric to said first arc, and (c) by a radially inward and angularly local tooth within said second arc, said tooth being enterable in said recess and thus enabling a selective eccentric displacement of each print wheel, the angular location of said recess being such as to enable selective eccentric displacement of a print wheel in the direction to withdraw the same from printing exposure, whereby print wheels not involved in the cluster determined by selective longitudinal placement of said pawl may be withdrawn from printing exposure.

5. The printing machine of claim 4, in which the inner end of said tooth is on the same geometrical cylinder as said first arc, whereby the associated print wheel derives stabilized concentric support from said shaft means at all rotary positions thereof except the angularly local region of tooth registration with said recess.

6. The printing machine of claim 5, in which said local region of tooth registration with said recess is at angular offset from an indexible position of the associated print wheel.

7. The printing machine of claim 4, in which for each print wheel an associated index-retaining pawl is spring-urged in the generally radially inward direction of angularly-local print-wheel engagement, said radially inward direction being such in relation to the angularly local position of said recess accommodation of said tooth that the index-retaining pawl will resiliently retain the print wheel in its withdrawn position in the absence of operative indexing-pawl engagement with the withdrawn print wheel.

8. The printing machine of claim 7, in which said shaft means is tubular at the region of print-wheel support, said recess being characterized by spaced parallel generally radial sidewalls of an elongate slot wherein the geometric planes of both sidewalls are offset from and on the same side of the axis of said shaft means, said tooth for each wheel being of similar generally radial and offset nature, the direction of off-radial offset being such as (a) to cam a print wheel into spring-retention of its retracted position under the passive action of its associated retaining pawl and (b) to cam the print wheel out of retracted position and into printing exposure in response to the rotary-displacement action of an indexing-pawl engagement.

9. The printing machine of claim 1, in which said last-mentioned means comprises a crank journalled for rotary oscillation on the axis of said shaft means and outboard of one of said pedestals, and means connecting said crank to said swing for imparting rotary oscillation to said swing.

10. The printing machine of claim 2, in which said shaft means includes a tubular member supporting all print wheels and supported by both pedestals, said crank having separate crankshaft support within said tubular member, and torsionally compliant means engaging said crankshaft within said tubular member and constantly urging said crank to one limit of its oscillatable displacement.

11. The printing machine of claim 10, in which the pedestal adjacent said crank has an arcuate slot at radial offset from the crankshaft axis, the crank-to-swing connection being via said slot.

12. The printing machine of claim 1, in which said pawl has longitudinally spaced arms each of which is rod-supported, said spring means being a coil spring which is rod-supported between said pawl arms, whereby selective longitudinal displacement of said pawl includes such displacement of said spring.

* * * * *